US005220867A

United States Patent [19]

Carpenter

[11] Patent Number: 5,220,867

[45] Date of Patent: Jun. 22, 1993

[54] ADJUSTABLE TENSION SILK SCREEN FRAME

[76] Inventor: Robert C. Carpenter, 1102 Grant Street, Caldwell, Id. 83605

[21] Appl. No.: 746,732

[22] Filed: Jul. 15, 1991

[51] Int. Cl.[5] ..... B41L 13/02

[52] U.S. Cl. ..... 101/127.1; 101/128.4

[58] Field of Search ..... 101/127.1, 128.1, 128.4, 101/129; 38/102, 102.1, 102.3, 102.91; 160/374.1, 378, 380, 381

[56] References Cited

U.S. PATENT DOCUMENTS

| | | | |
|---|---|---|---|
| 3,230,872 | 1/1966 | Groot | 101/127.1 |
| 3,482,343 | 12/1969 | Hamu | 101/127.1 |
| 3,706,376 | 12/1972 | Krause | 101/127.1 |
| 4,041,861 | 8/1977 | Alter | 101/127.1 |

FOREIGN PATENT DOCUMENTS 9203231 3/1992 PCT Int'l Appl. .

*Primary Examiner*—Edgar S. Burr
*Assistant Examiner*—Ren Yan
*Attorney, Agent, or Firm*—Frank J. Dykas; Craig M. Korfanta; Ken J. Pedersen

[57] ABSTRACT

Adjustable tension silk screen frame (10) of the floating bar type is disclosed. Retensionable stretch and glue screen printing frame (10) uses screen attachment members (13) of specific cross section to maximize the available printing surface provided by the screen frame, thereby allowing a printer to utilize standard wooden screen printing frames in constructing an adjustable tension screen printing frame without sacrificing available printing space or adding unnecessary weight.

5 Claims, 6 Drawing Sheets (PRIOR ART)

ADJUSTABLE TENSION SILK SCREEN FRAME

RELATED APPLICATIONS

This application is a continuation-in-part application of International Application Number PCT/US90/04675, filed Aug. 20, 1990 by Robert C. Carpenter. Applicant hereby claims the priority of said International Application under 35 U.S.C. § 120 and 35 U.S.C. § 365.

BACKGROUND OF THE INVENTION

1. Technical Field

This invention generally relates to screen printing apparatus, commonly known as silk screening apparatus, and more particularly, this invention relates to an adjustable and retensionable screen frame for industrial use.

2. Background Art

One of the more common and most versatile of the printing processes is that of screen printing, or more commonly known as silk screen printing. Screen printing can be used to print on paper products, wood, plastics, textiles, etc. One of the most versatile industrial uses of screen printing is the printing of designs on textiles used in clothing, home decorating and the like. Because of the extreme versatility associated with the screen printing process, screen printing is the method of choice for a wide variety of mediums. Also, the screen printing process is well suited for printing designs on textile articles after they have been assembled, e.g., shirts, uniforms, hats and the like. This is the primary concern of the instant invention.

When printing detailed designs and/or multi-colored designs on a textile product, it is imperative that the printing screen be held extremely taut to insure accurate registration of the fine detail and/or various colors. The prior art solutions to this problem can be classified into three general categories. The first prior art solution, which is only a partial solution, has the screen material, typically nylon or polyester, glued under tension to a wooden perimeter frame. It is fairly common to have the screen pre-tensioned under the specific factory requirements during the gluing process. Unfortunately, screens tend to relax over time and consequently less workable tension is left in the fabric. Sometimes this occurs even before the screen is used on the production line.

A second prior art solution involves an adjustable tension frame which uses tension rollers along the frame sides to tension the screen material. This frame is commonly known as the Newman Roller Frame available from Stretch Devices, Inc. of Philadelphia, Pa. While these devices work well, they are extremely expensive.

A third prior art solution represents a compromise between the first two and consists of a floating bar type frame. Floating bars are suspended around the inner perimeter of the frame by traveler screws and wing nuts. Once the screen material has been attached to the floating bars, the wing nuts are tightened drawing the floating bars closer to the frame away from the center of the screen material, thus tightening the screen. Unfortunately, the floating bars occupy a significant amount of space within the interior of the frame and therefore limit the design space area. Additionally, the double frame configuration is quite heavy. In order to print a larger design, the printer must use the next available larger frame size and consequently an excessive amount of screen material, which is quite expensive.

An additional problem with tensioning the polyester screen material, is that as it is tensioned both laterally and longitudinally, extremely high tension stresses are developed in the corner pocket areas. As a result, the screen often tears and is rendered useless.

What is needed is an adjustable tension screen printing frame which is inexpensive to construct and which does not require an excessive amount of screen material to implement a particular design and which can be retensioned after use to maintain original factory tension specifications. It is therefore an object of the instant invention to provide an adjustable tension screen printing frame which is of a simple and inexpensive construction and which optimizes the amount of available screen area to accommodate large designs. It is an additional object of the instant invention to eliminate tearing of a retensionable polyester screen by reducing the stress in the pocket areas.

DISCLOSURE OF INVENTION

The first and other objects are accomplished by the use of floating screen attachment members of specific cross section in connection with a standard screen printing frame. Here the floating screen attachment members are manufactured from a strong light-weight material such as aluminum and have a minimum cross section, such as an "L" shape. Additionally, the instant invention can utilize a U-shaped cross section and a modified U-shaped cross section as will be explained hereinafter.

The second and other objects are accomplished by a method of construction which has the screen pre-tensioned and glued to the floating bars and additionally spot glued to the four corners of the rigid frame. The significant result is that when the screen relaxes and is re-tensioned, the relative stress difference between the printing portion of the screen and the corner pocket areas is greatly reduced.

The L-shaped screen attachment members are attached in overlapping fashion along the inner perimeter sides of the frame such that a vertical face of the screen attachment member is disposed essentially parallel and in closely spaced relation to the inner sides of the perimeter frame such that only a very small amount of screen printing space is occupied by the screen attachment members. A perpendicular screen attachment surface overlaps the top surface of the perimeter frame and is substantially parallel to the top surface. The L-shaped screen attachment members float on traveler screws which are adjustable via a hex or wing nuts to tension an attached screen member.

Similarly, screen attachment members having a U-shaped cross section can be utilized providing that the width of the U-shaped cross section is only slightly wider than the width of the frame members. Here, the screen attachment members are attached with the parallel sides of the U-shaped cross section disposed parallel to the top and bottom surfaces and the interconnecting vertical side of the U-shaped cross section is disposed parallel to the inner side surfaces of the perimeter frame. Again the screen attachment members float on traveler screws allowing an attached screen member to be tensioned by tightening the traveler screws wing or hex nuts. This particular embodiment of the invention allows a screen to be attached on either side of the perimeter frame. This can be advantageous in that when a screen attached to one side wears out, it can be cut away and a new screen installed on the other side without having to replace or refinish the screen attachment members.

Yet another embodiment of the instant invention uses a modified U-shaped cross section attachment member which is essentially lopsided, i.e., one of the sides of the U-shaped cross section is much shorter in length than the other. Additionally, the width of the U-shaped cross sectional area does not need to be wider than the width of the perimeter being. In fact, for compactness, it is desirable that the width of the screen attachment member be between two-thirds to equal of that of the perimeter frame. Here, the shorter side of the U-shaped cross section is fulcrumed against the interior side of the perimeter frame such that it acts as a cantilevered point for the traveler screw, against which an attached screen member is tensioned by tightening the hex or wing nut on the traveler screw.

BEST MODE FOR CARRYING OUT INVENTION

Figure 2:
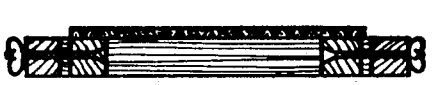
FIG. 2 (PRIOR ART)
FIG. 2 is a side cross sectional view of the prior art screen printing frame of FIG. 1.
Figure 1:
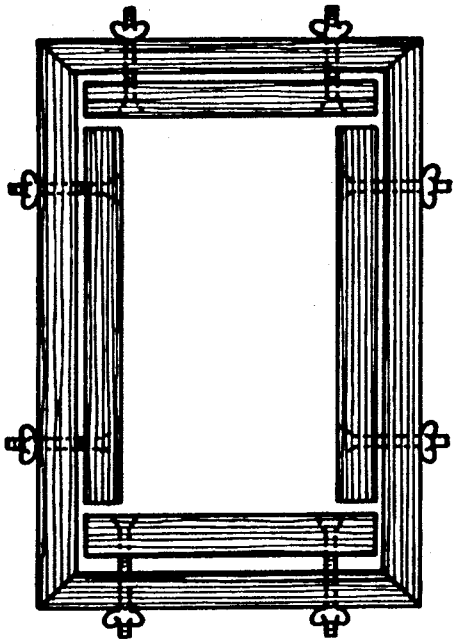
FIG. 1 is a top plan view of a prior art floating bar screen printing frame.
Figure 3:
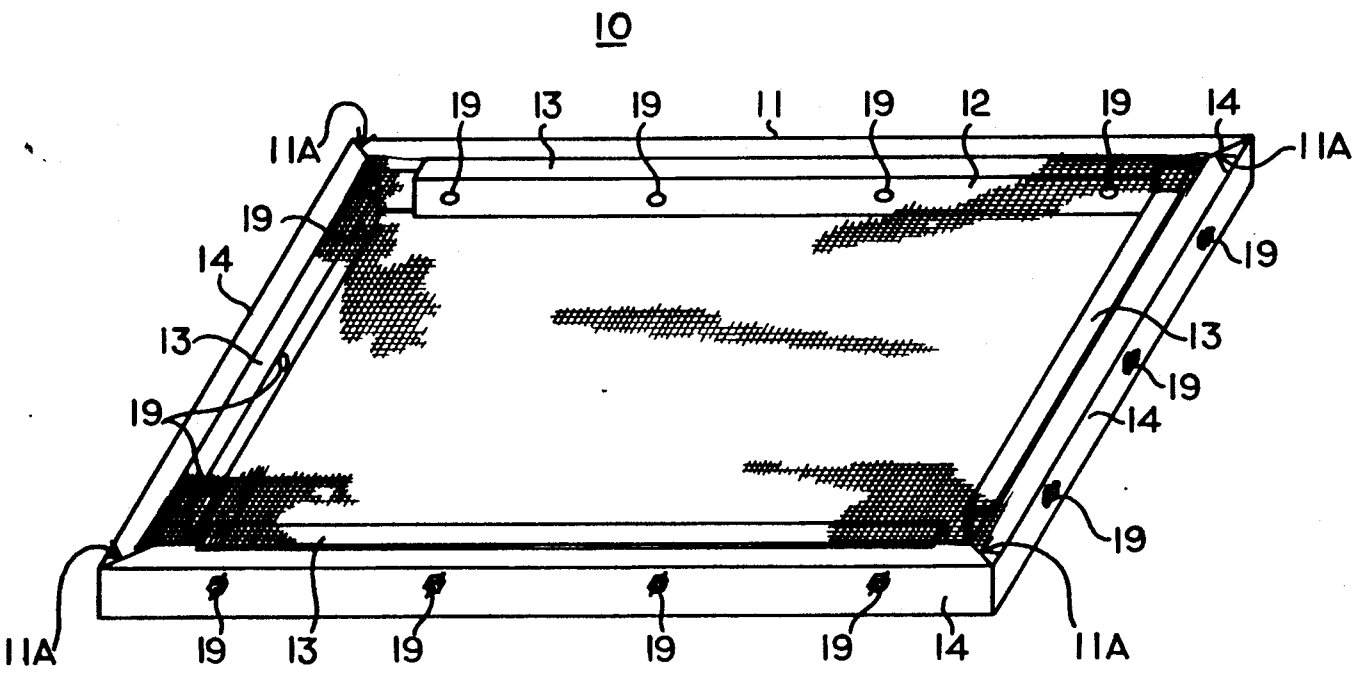
FIG. 3 is a three-quarter view of a first embodiment of the instant invention, showing the new screen attachment members in use.
Figure 4:
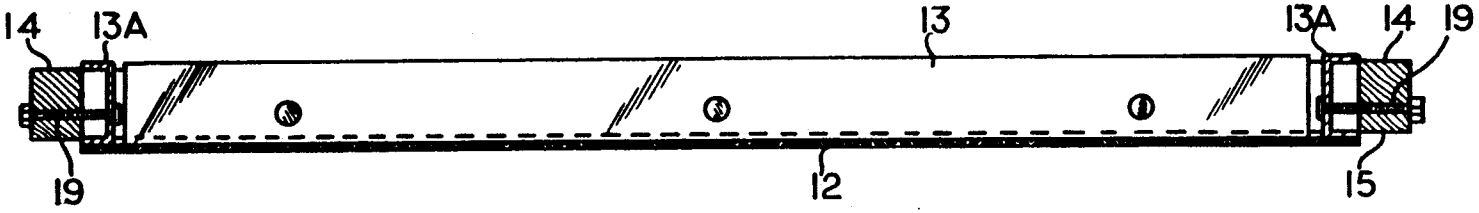
FIG. 4 is a side cross section of the screen printing frame of FIG. 3.
Figure 5:
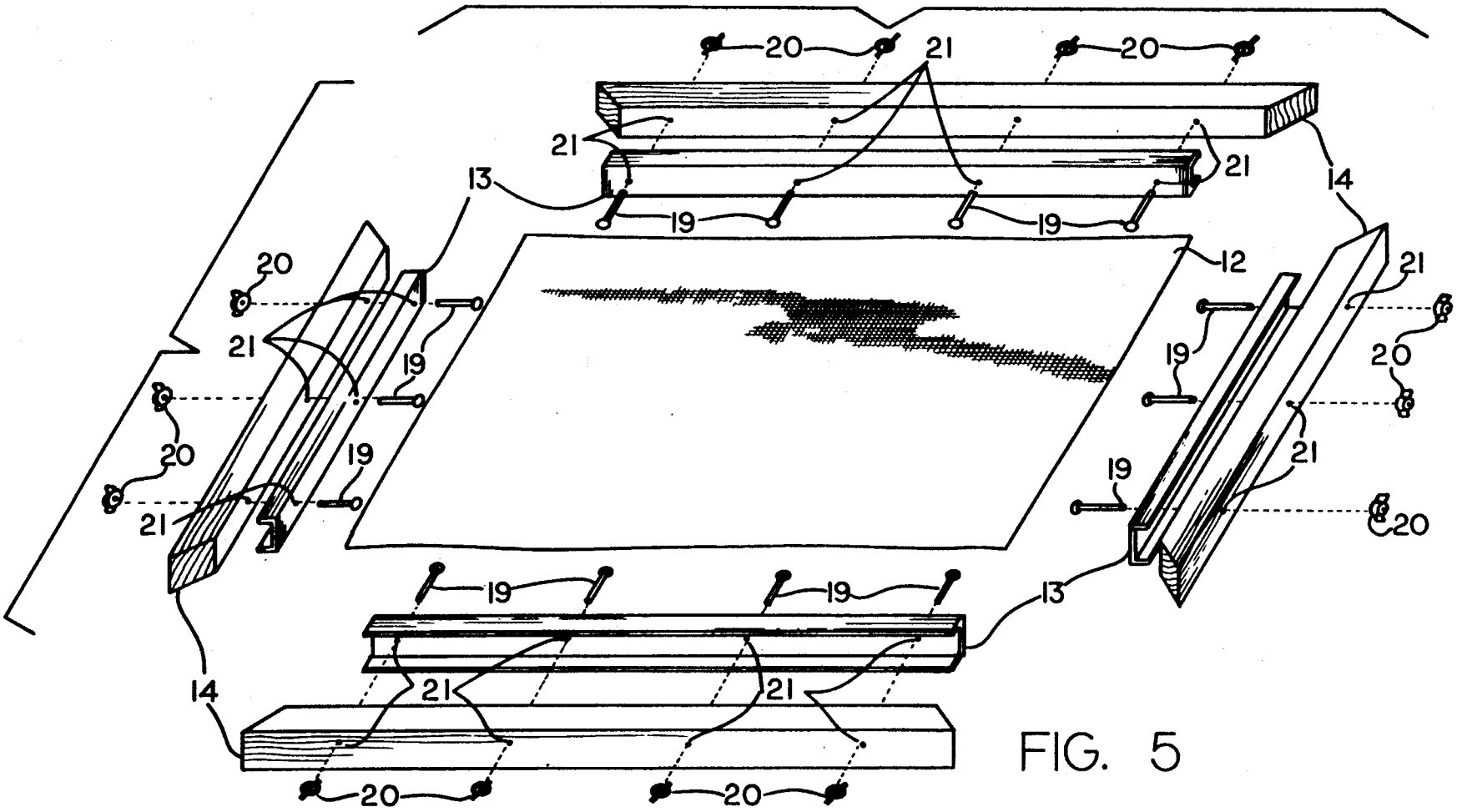
FIG. 5 is an assembly drawing of the screen printing frame of FIGS. 3 and 4.

Referring now to FIGS. 3, 4 and 5, a first embodiment of the retensionable stretch and glue screen printing frame 10 is shown. Adjustable tension screen frame 10 includes a four-sided rigid frame 11 constructed from elongated side members 14. Elongated side members 14 are generally manufactured from a rigid material such as wood or the like. Screen attachment members 13 of specific cross section are "floatably" attached along the inner perimeter face 17 of rigid frame 11.

In this first embodiment of the figures, screen attachment members 13 are elongated segments of U-shaped aluminum channel 13*a*. U-shaped screen attachment members 13*a* have two parallel sides separated by a vertical side which is disposed parallel to inside perimeter face 17 of elongated side members 14. The vertical side of U-shaped screen attachment member 13*a* is of sufficient length such that the entire channel member can straddle the adjacent elongated side member 14 without the parallel sides of the channel member being engaged by the side members 14. A plurality of traveler screw holes 21 are provided in both the U-shaped cross section screen attachment members 13 and the adjacent elongated side members 14 for receiving traveler screws or bolts 19. The bolt heads of traveler screws 19 are engaged against the inward facing vertical surface of screen attachment members 13*a*. A cooperating hex or wing nut 20 is engaged on the threaded end of traveler screws 19 and purchased against the outside facing vertical face 18 of elongated side members 14, such that tightening adjustment nut 20 causes screen attachment members 13*a* to move in a direction away from the frame center.

A Pre-tensioned screen member 12 is glued or otherwise attached along the top faces of the side member on each screen attachment member 13*a*. These faces are disposed generally parallel to the top face 15 of elongated side members 14. Top faces 15 lie in a first coordinate plane as a consequence of the construction of four-sided rigid frame 11. Screen member 12 is attached to screen attachment members 13*a* to define a second coordinate plane which lies parallel to the first coordinate plane. Identically, screen attachment members 13*a* provide a plurality of screen attachment surfaces which are parallel to bottom faces 16 such that screen member 12 could be attached to either side of rigid frame 11. Screen member 12 is also spot glued to the corner areas 11*a* of rigid frame 11

Figure 7:
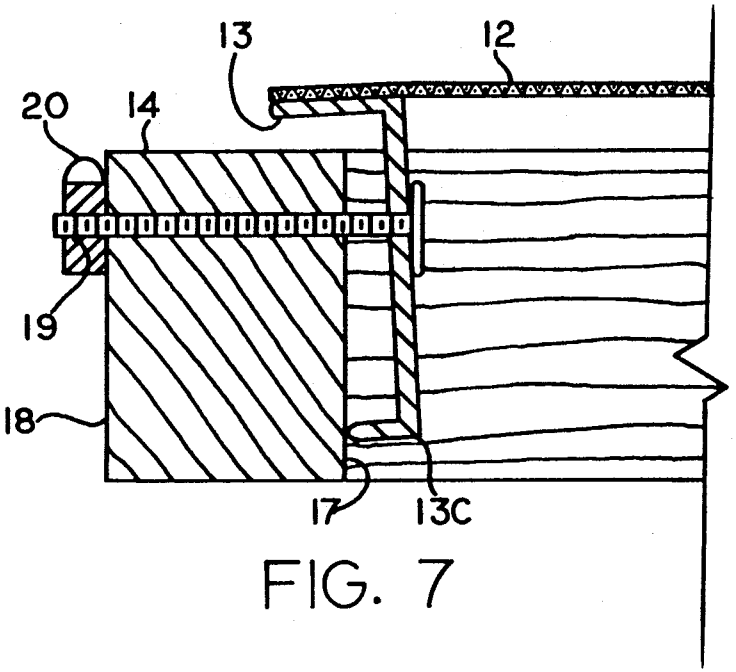
FIG. 7 is an enlarged cross sectional side view of a third embodiment of the instant invention.
Figure 6:
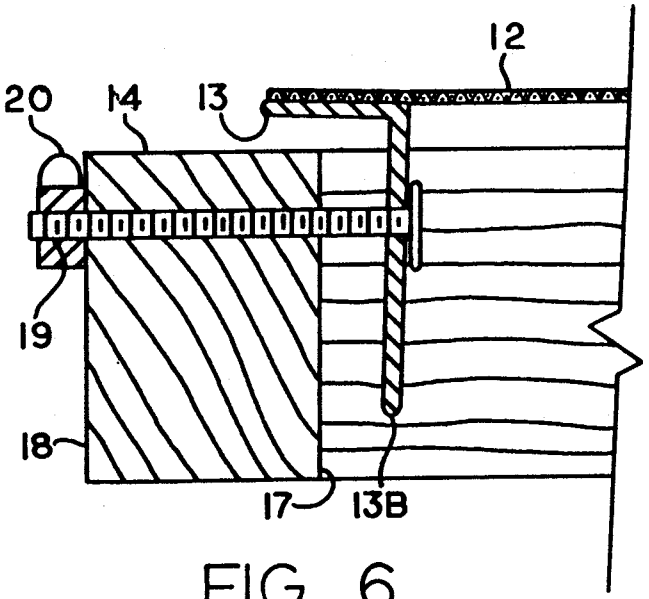
FIG. 6 is an enlarged cross sectional side view of a second embodiment of the instant invention.

Referring now to FIGS. 6 and 7, a second and third embodiment of the present invention are shown. The second and third embodiments are identical in all respects to that of the first embodiment with the exception of the shape of the cross section of screen attachment members 13. FIG. 6 shows an L-shaped cross section screen attachment member 13*b* whose operation is the same as that of the first embodiment with the exception of there only being one attachment surface instead of two.

FIG. 7 shows a screen attachment member 13*c* having a modified or lopside U-shaped cross section. It should also be pointed out that the length of the vertical face connecting the parallel side members of the U-shaped screen attachment member 13*c* is substantially less than that of the first embodiment. This positions the shorter of the two parallel sides against the inner face 17 to provide a fulcrum point against which traveler screw 19 cantilevers screen attachment member 13*c*. This particular configuration tends to counteract the reactionary moment produced by the screen on the screen attachment members and is particularly useful for printing on a large flat surface on which it is important that the frame and frame attachment members do not contact the printing surface and prevent the screen from actually touching the surface.

Figure 8:
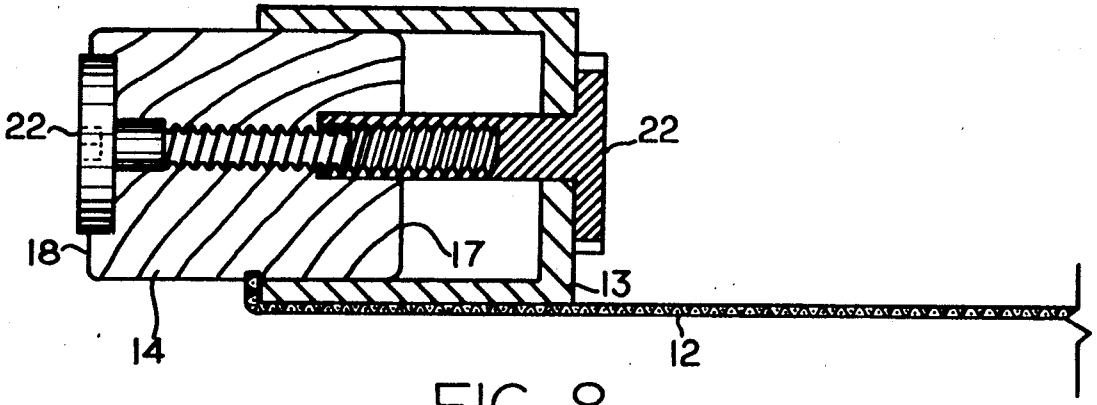
FIG. 8 is an enlarged cross sectional side view of a fourth embodiment of the instant invention.

FIG. 8 shows a fourth embodiment of the instant invention which uses the same basic frame and screen attachment configuration as that of the first embodiment with the exception of the traveler screw. Here, a binding screw 22 is used in place of the bolt and wing-nut assembly to tension the printing screen.

While the foregoing detailed descriptions have the screen attachment members attached along the inside perimeter of the frame, they could equally well be attached along the outside perimeter having the traveler screws push instead of pull the attachment members to tension the screen.

While there is shown and described the present preferred embodiment of the invention, it is to be distinctly understood that this invention is not limited thereto but may be variously embodied to practice within the scope of the following claims.

I claim:

1. An adjustable tension screen frame characterized by:

a rigid frame having a plurality of sides connected at corner points one to the other to define a first coordinate plane and an available printing area within said frame;

a plurality of elongated screen attachment members disposed within the available printing area and each being configured for being held in adjustable parallel spaced relationship to said rigid frame along one side thereof, said screen attachment members each having a screen attachment surface disposed in spaced and parallel relation to said first coordinate plane such that said screen attachment surfaces define a second coordinate plane;

adjustable position attachment means being interconnected between said rigid frame and said screen attachment members for attaching said screen attachment members in adjustable parallel spaced relationship with said rigid frame and for translating said screen attachment surfaces within said second coordinate plane for adjusting the tension on an attached silk screen member; and a prestretched screen member, lying substantially in said second coordinate plane, and being attached to and along the length of said silk screen attachment surfaces and to the corner points on said rigid frame and lying substantially in said second coordinate plane.

2. The adjustable tension silk screen frame of claim 1 wherein said screen attachment members additionally have a frame attachment surface being attached to said screen attachment surface in perpendicular relationship thereto.

3. The adjustable tension silk screen frame of claim 2 wherein said adjustable position attachment means comprises a plurality of traveler screws being attached to said screen attachment members and threadedly purchased against said rigid frame for tensioning said silk screen member.

4. An adjustable tension silk screen frame characterized by:

a four-sided rectangular rigid frame having corner points lying in and defining a first coordinate plane, each of the four sides being an elongated member of square cross section being disposed within said frame to define top and bottom frame faces lying parallel to said first coordinate plane and to define inside and outside perimeter faces lying perpendicular to said first coordinate plane, said frame defining an available printing area within said frame;

a set of four screen attachment members disposed within the available printing area and each being adjustably attached in parallel spaced relationship to one of the four sides, and each one of which having at least two surfaces, a first screen attachment surface and a second frame attachment surface, said screen attachment surfaces being disposed in parallel planar relationship to said top and bottom sides of said frame and said frame attachment surfaces each being disposed parallel to one inside perimeter face;

a plurality of traveler screws being attached to said frame attachment surfaces, through said side and purchased against said sides for translating said screen attachment surfaces in a plane parallel to said first coordinate plane; and a screen member being prestretched and attached to said screen attachment surfaces and to the corner points on said rigid frame.

5. In a rigid silk screen frame of rectangular configuration having four sides and corner points lying in a coordinate plane where each of the four sides is an elongated member of square cross section being positioned to define top and bottom frame faces lying parallel to said coordinate plane and inside and outside perimeter faces lying perpendicular to said coordinate plane to define an available printing area within the perimeter of said frame, a screen tensioning device characterized by:

a set of four screen attachment members disposed within the available printing area, each one of which being adjustably attached in parallel spaced relationship to one of the four sides and each one of which having at least two surfaces, a first screen attachment surface and a second frame attachment surface, said screen attachment surfaces being disposed in parallel planar relationship to said top and bottom sides of said frame and said frame attachment surfaces each being disposed parallel to one inside perimeter face;

a plurality of traveler screws being attached to said frame attachment surfaces, through said side and purchased against said sides for translating said screen attachment surfaces in a plane parallel to said first coordinate plane; and a screen member being prestretched and attached to said screen attachment surfaces and to the corner points on said rigid frame.

* * * * *